US012410631B1

(12) United States Patent
Schmidt

(10) Patent No.: US 12,410,631 B1
(45) Date of Patent: Sep. 9, 2025

(54) PROTECTIVE TENT FOR SPEAKERS

(71) Applicant: Christopher Schmidt, Port Murray, NJ (US)

(72) Inventor: Christopher Schmidt, Port Murray, NJ (US)

( * ) Notice: Subject to any disclaimer, the term of this patent is extended or adjusted under 35 U.S.C. 154(b) by 251 days.

(21) Appl. No.: 18/118,241

(22) Filed: Mar. 7, 2023

(51) Int. Cl.

| | |
|---|---|
| ***E04H 15/36*** | (2006.01) |
| ***E04H 15/02*** | (2006.01) |
| ***E04H 15/44*** | (2006.01) |
| ***E04H 15/54*** | (2006.01) |
| ***E04H 15/58*** | (2006.01) |
| ***E04H 15/64*** | (2006.01) |

(52) U.S. Cl.
CPC ..... *E04H 15/02* (2013.01); *E04H 15/36* (2013.01); *E04H 15/44* (2013.01); *E04H 15/54* (2013.01); *E04H 15/58* (2013.01); *E04H 15/64* (2013.01)

(58) Field of Classification Search
CPC ..... E04H 15/36
See application file for complete search history.

(56) References Cited

U.S. PATENT DOCUMENTS

| | | | | |
|---|---|---|---|---|
| 1,533,820 | A | 4/1925 | Whitehead | |
| 3,448,748 | A * | 6/1969 | Walrave | E04H 15/28 135/120.3 |
| 4,069,832 | A * | 1/1978 | Bingham | E04H 15/48 428/542.2 |
| 4,590,956 | A * | 5/1986 | Griesenbeck | E04H 15/56 5/113 |
| 5,291,855 | A * | 3/1994 | Laverty | A01K 39/0113 D30/128 |
| 5,311,813 | A | 5/1994 | Fairbanks | |
| 5,655,558 | A * | 8/1997 | Child | E04H 15/48 135/147 |
| 5,755,176 | A * | 5/1998 | Edwards | A01K 5/01 119/51.01 |
| 6,425,668 | B1 * | 7/2002 | Jacob | G03B 21/00 353/62 |
| 6,857,246 | B2 * | 2/2005 | Erbetta | E04H 15/36 135/147 |
| 7,826,633 | B2 | 11/2010 | Davi | |
| 9,033,105 | B1 * | 5/2015 | Boswell | A01M 31/02 182/115 |
| D763,231 | S | 8/2016 | Sonoda | |
| 9,695,610 | B2 | 7/2017 | Sonoda | |
| 10,280,644 | B2 * | 5/2019 | Bunce | E04H 15/56 |
| 10,385,584 | B2 * | 8/2019 | Morta | E04H 9/024 |
| 10,927,563 | B2 * | 2/2021 | Geise | E04H 4/06 |
| 2004/0025927 | A1 | 2/2004 | Hilmersen | |
| 2020/0299989 | A1 * | 9/2020 | Barnes | F41H 7/02 |

FOREIGN PATENT DOCUMENTS

| | | |
|---|---|---|
| WO | 2004092021 | 10/2004 |

* cited by examiner

*Primary Examiner* — Noah Chandler Hawk

(57) ABSTRACT

The protective tent for speakers includes a base, a plurality of support armatures, and a tent body. The protective tent for speakers may shield a speaker to protect the speaker from damage due to weather. The base and the plurality of support armatures may form a framework to support the tent body. The tent body may be operable to enshroud the speaker. The tent body may be water repellent such that the speaker enclosed within the tent body may stay dry during a rainstorm. In some embodiments, the protective tent for speakers may further comprise a speaker stand to support the base, the plurality of support armatures, the tent body, and the speaker at an elevated position.

13 Claims, 5 Drawing Sheets

PROTECTIVE TENT FOR SPEAKERS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of audio equipment for outdoor use and weather-protective covers, more specifically, a protective tent for speakers.

SUMMARY OF INVENTION

The protective tent for speakers comprise a base, a plurality of support armatures, and a tent body. The protective tent for speakers may shield a speaker to protect the speaker from damage due to weather. The base and the plurality of support armatures may form a framework to support the tent body. The tent body may be operable to enshroud the speaker. The tent body may be water repellent such that the speaker enclosed within the tent body may stay dry during a rainstorm. In some embodiments, the protective tent for speakers may further comprise a speaker stand to support the base, the plurality of support armatures, the tent body, and the speaker at an elevated position.

An object of the invention is to provide a base and a plurality of support armatures that form a framework to support a tent body.

Another object of the invention is to provide a tent body that may enshroud a speaker that is placed within the framework.

A further object of the invention is to provide a tent body made of water repellent fabric to protect the speaker from damage due to inclement weather.

Yet another object of the invention is to provide a speaker stand to elevate the weather-protected speaker to an elevated position.

These together with additional objects, features and advantages of the protective tent for speakers will be readily apparent to those of ordinary skill in the art upon reading the following detailed description of the presently preferred, but nonetheless illustrative, embodiments when taken in conjunction with the accompanying drawings.

In this respect, before explaining the current embodiments of the protective tent for speakers in detail, it is to be understood that the protective tent for speakers is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the protective tent for speakers.

It is therefore important that the claims be regarded as including such equivalent construction insofar as they do not depart from the spirit and scope of the protective tent for speakers. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
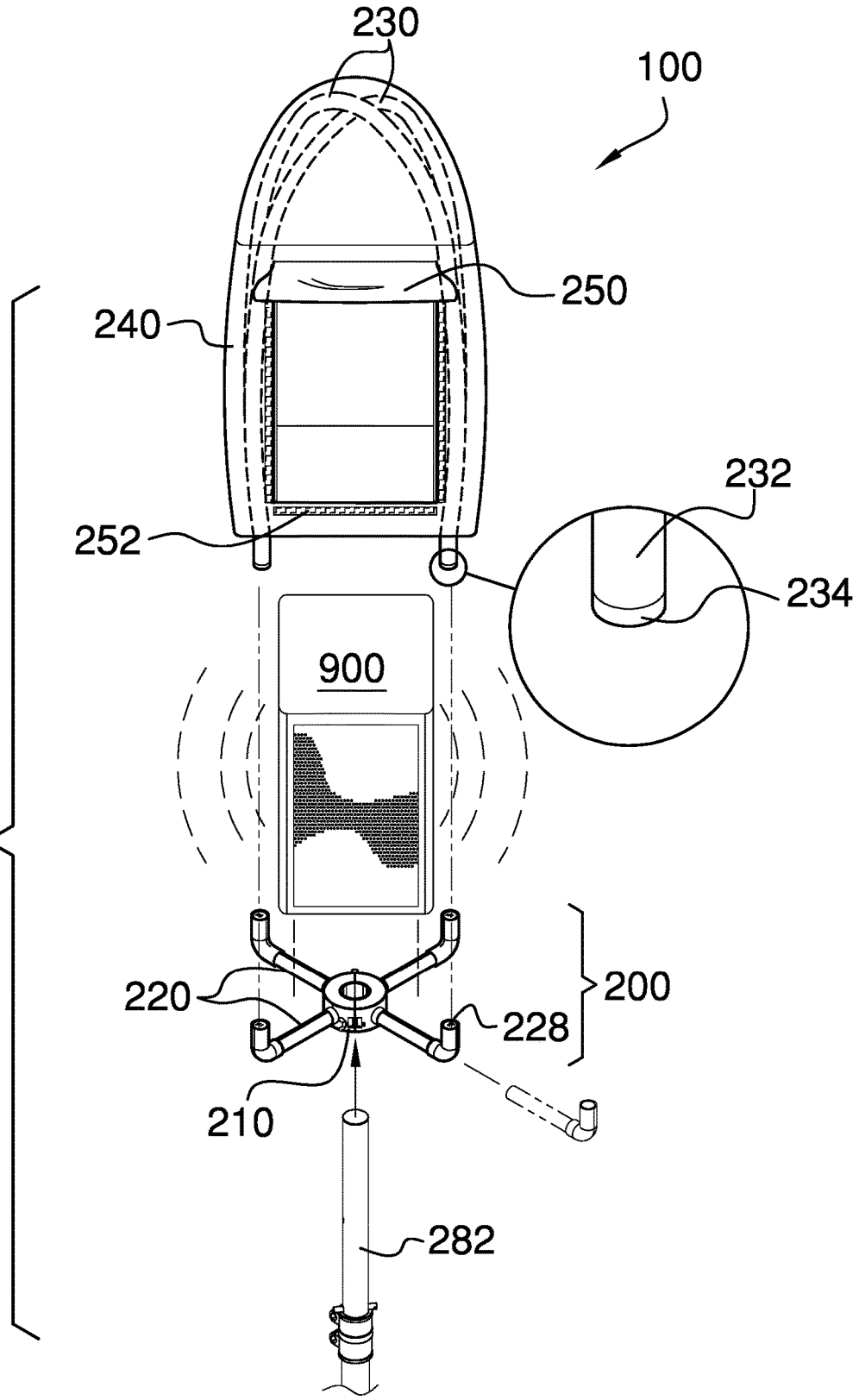
FIG. 1 is an exploded view of an embodiment of the disclosure.
Figure 2:
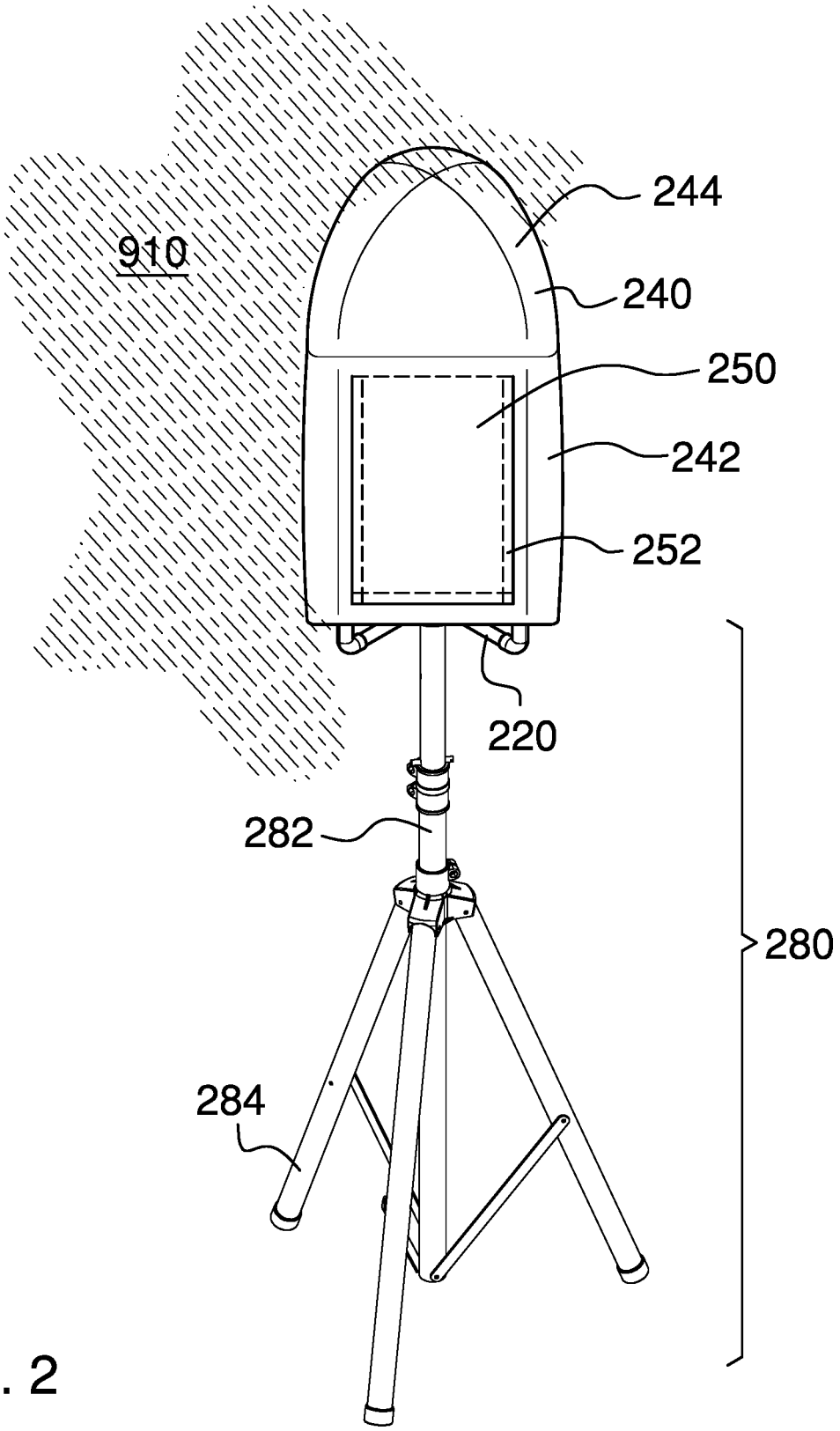
FIG. 2 is an isometric view of an embodiment of the disclosure.
Figure 3:
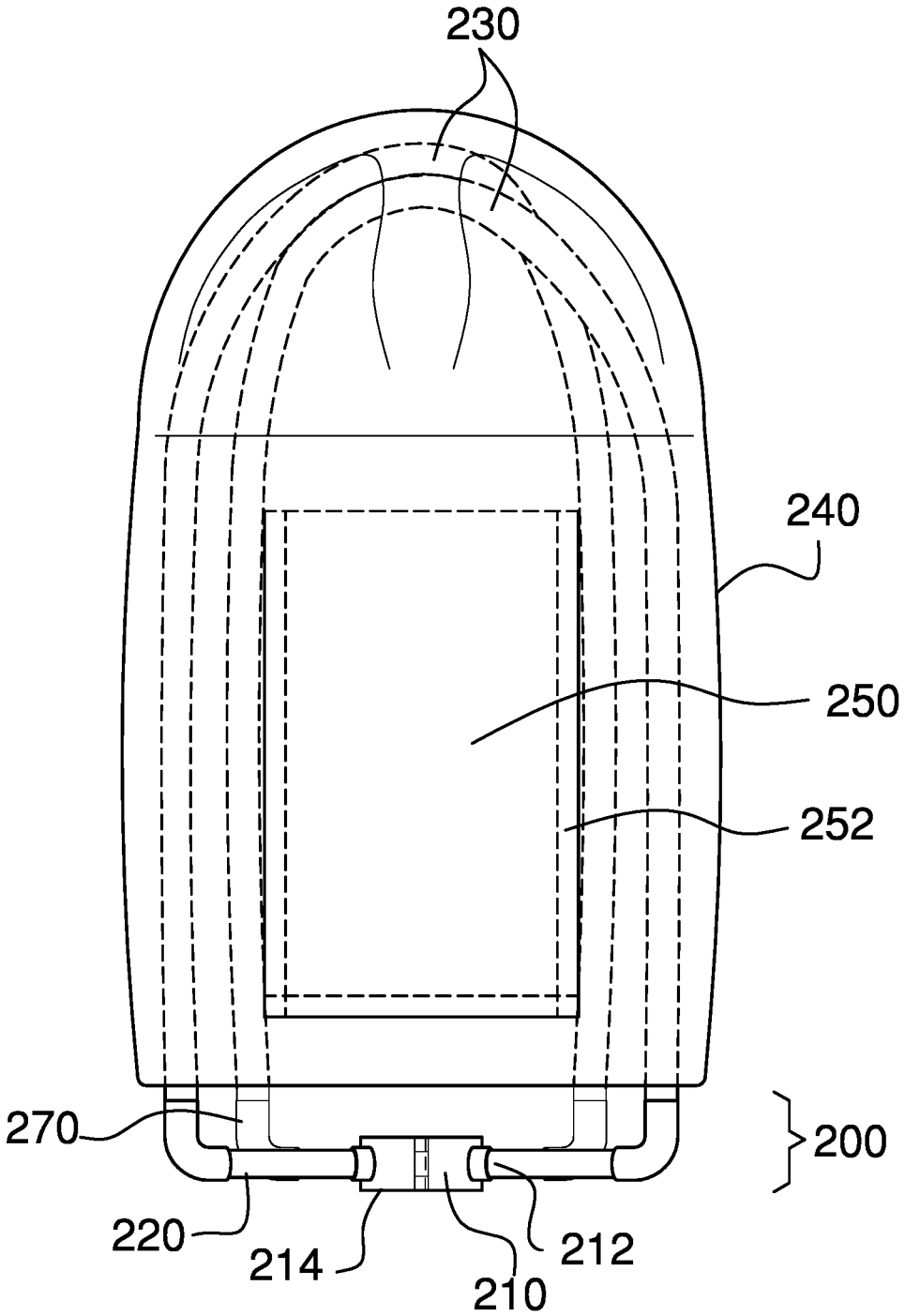
FIG. 3 is a rear view of an embodiment of the disclosure.
Figure 4:
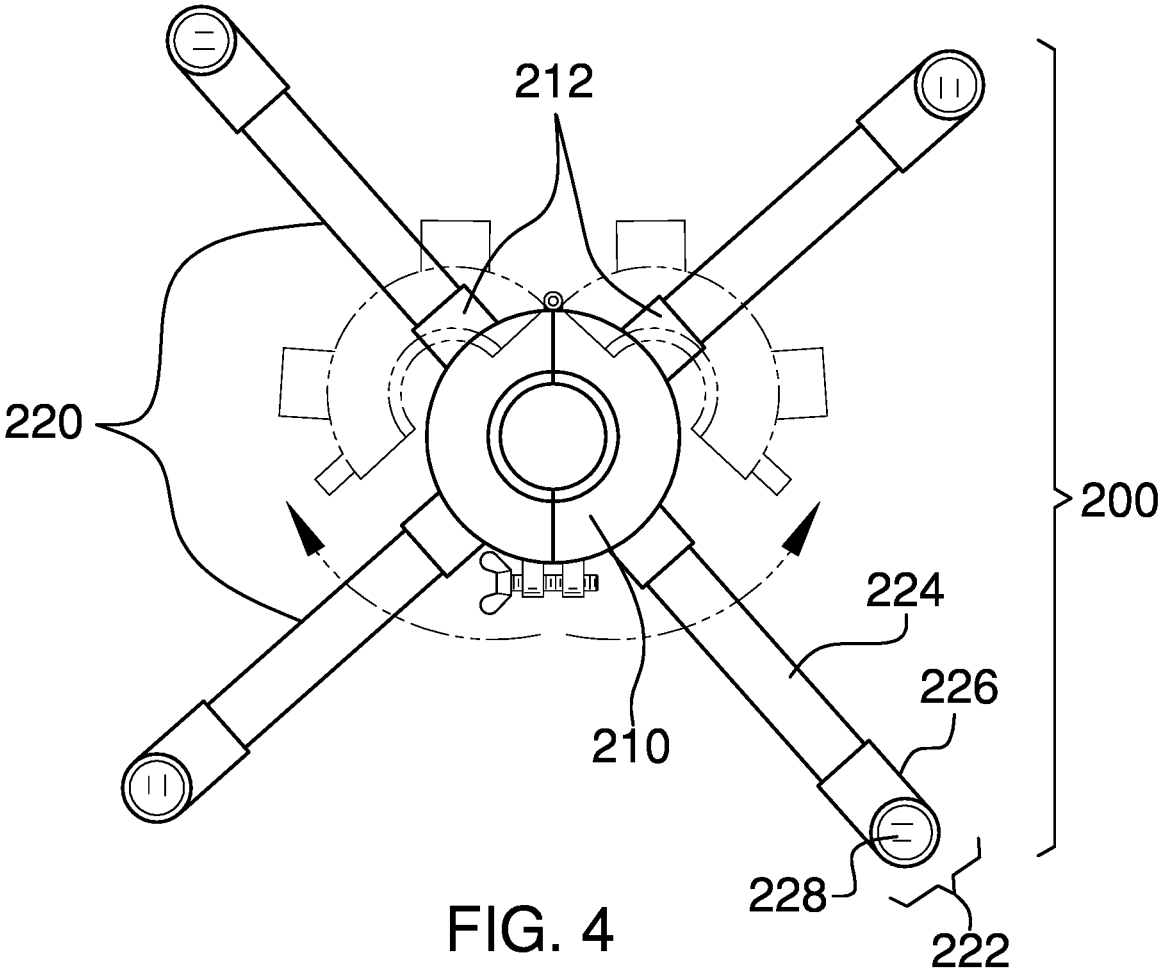
FIG. 4 is a top view of an embodiment of the disclosure, illustrating the base and speaker stand only.
Figure 5:
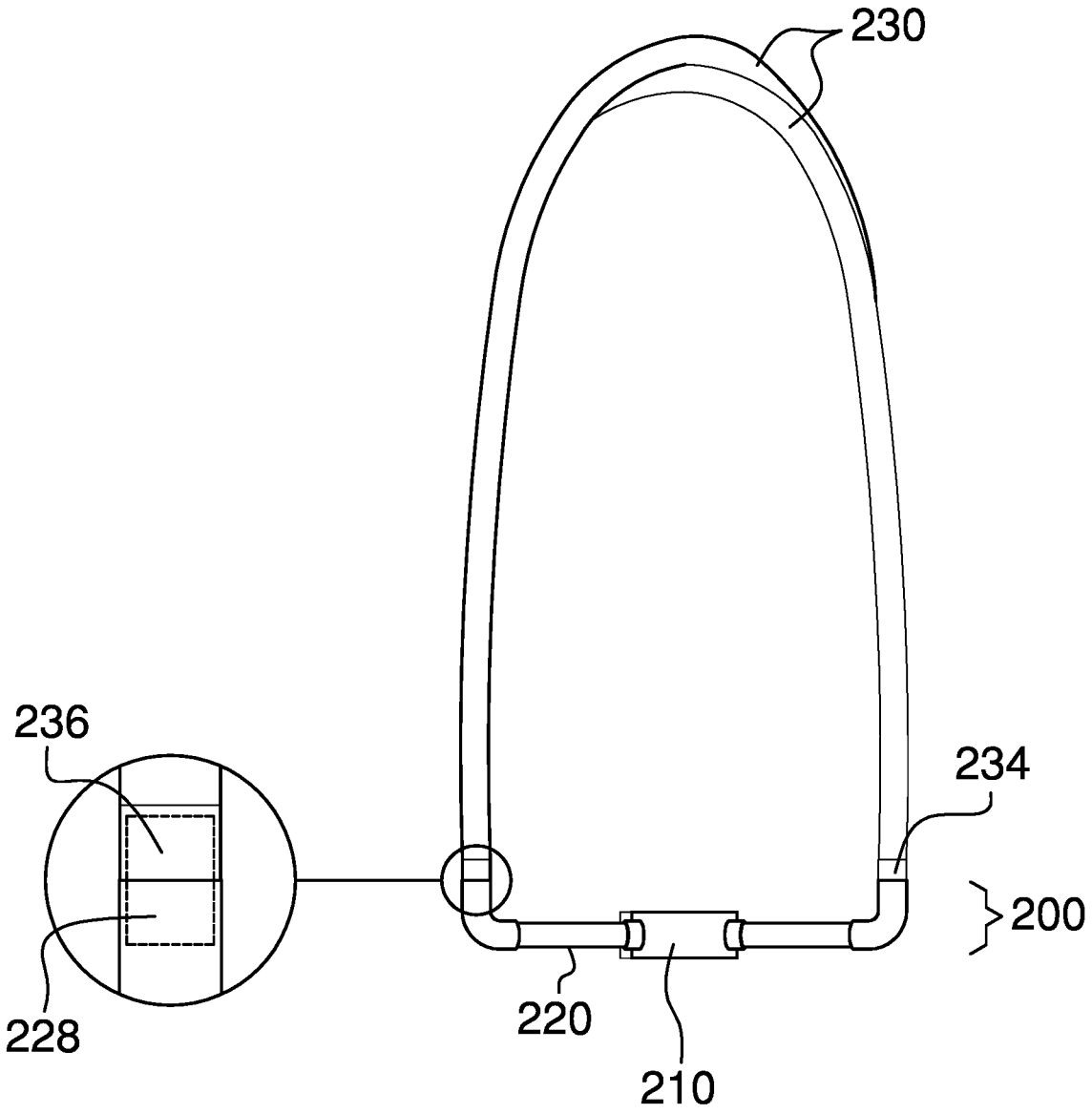
FIG. 5 is a detail side view of an embodiment of the disclosure, illustrating the tent body removed.

Detailed reference will now be made to a first potential embodiment of the disclosure, which is illustrated in FIGS. 1 through 5.

The protective tent for speakers 100 (hereinafter invention) comprises a base 200, a plurality of support armatures 230, and a tent body 240. The invention 100 may shield a speaker 900 to protect the speaker 900 from damage due to weather. The base 200 and the plurality of support armatures 230 may form a framework to support the tent body 240. The tent body 240 may be operable to enshroud the speaker 900. The tent body 240 may be water repellent such that the speaker 900 enclosed within the tent body 240 may stay dry during a rainstorm 910. In some embodiments, the invention 100 may further comprise a speaker stand 280 to support the base 200, the plurality of support armatures 230, the tent body 240, and the speaker 900 at an elevated position.

The base 200 may be the bottom of the framework that supports the tent body 240. The base 200 may comprise a stand interface 210 and a plurality of arms 220. The stand interface may be a central disk located at the center of the base 200. The stand interface 210 may comprise a plurality of arm apertures 212 dispersed around the side of the stand interface 210 for coupling the plurality of arms 220 to the stand interface 210. The stand interface 210 may comprise a stand aperture 214 at the bottom center of the stand interface 210.

The plurality of arms 220 may be coupled to the stand interface 210 via the plurality of arm apertures 212. The plurality of arms 220 may be radially-oriented and equally spaced around the stand interface 210. An individual arm 222 selected from the plurality of arms 220 may comprise a straight armature 224, a 90 degree elbow 226, and a first magnet 228. The straight armature 224 may extend away from the stand interface 210 to define the diameter of the invention 100.

A first end of the 90 degree elbow 226 may be coupled to the distal end of the straight armature 224. The 90 degree elbow 226 may turn 90 degrees such that a second end of the 90 degree elbow 226 may be pointed vertically upwards. The first magnet 228 may be coupled to the second end of the 90 degree elbow 226.

The plurality of support armatures 230 may couple to the 90 degree elbows 226 located at the distal ends of the plurality of arms 220 to form an arching structure that extends vertically upwards. The plurality of support armatures 230 may lift the center of the tent body 240 such that a hollow cavity may be formed within the tent body 240. The speaker 900 may be placed within the hollow cavity.

An individual support armature 232 selected from the plurality of support armatures 230 may be the shape of an inverted U. The individual support armature 232 may couple to the 90 degree elbows 226 of two opposing arms.

The individual support armature 232 may comprise a plurality of second magnets 234. An individual second magnet 236 selected from the plurality of second magnets 234 may be coupled to each end of the individual support armature 232. The first magnet 228 and the individual second magnet 236 may be magnetically polarized such that the first magnet 228 is attracted to the individual second magnet 236.

In a preferred embodiment, the invention 100 may comprise two support armatures. The two support armatures may be different vertical heights such that the bottoms of the two support armatures may be at the height of the 90 degree elbows 226 and the centers of the two support armatures may cross paths without interference.

The tent body 240 may be a water repellent fabric that fits over the plurality of support armatures 230 to form the hollow cavity. In some embodiments, the tent body 240 may comprise a cylindrical bottom 242 and a hemispherical top 244.

An access panel 250 may provide access to the speaker 900. The access panel 250 may open to expose an access aperture and may close to cover the access aperture. The access panel 250 may be located on the rear of the tent body 240. The access panel 250 may couple to the tent body 240 at the top of the access panel 250 and may be detached from the tent body 240 along the left side of the access panel 250, the right side of the access panel 250, and the bottom of the access panel 250. The bottom of the access panel 250 may lift up. An access panel fastener 252 may detachably couple the left side of the access panel 250, the right side of the access panel 250, and the bottom of the access panel 250 to the tent body 240. As non-limiting examples, the access panel fastener 252 may be one or more access door hook and loop fasteners or an access panel zipper. The access panel 250 may roll up when the access panel fastener 252 is detached.

In some embodiments, a plurality of tent body restraints 270 may be operable to detachably couple the tent body 240 to the framework such that wind does not lift the tent body 240 off. As non-limiting examples, the plurality of tent body restraints 270 may be tent body hooks on the tent body 240 that may couple to rings on the plurality of arms 220, tent body hook and loop fasteners, one or more drawstrings that may lash to the base 200 and/or the plurality of support armatures 230, or any combination thereof.

A sound flap may be provided to expose the front of the speaker 900 in good weather. The sound flap may open to expose a sound aperture and may close to cover the sound aperture. The sound flap may be located on the front of the tent body 240. The sound flap may couple to the tent body 240 at the top of the sound flap and may be detached from the tent body 240 along the left side of the sound flap, the right side of the sound flap, and the bottom of the sound flap. The bottom of the sound flap may lift up. A sound flap fastener may detachably couple the left side of the sound flap, the right side of the sound flap, and the bottom of the sound flap to the tent body 240. As non-limiting examples, the sound flap fastener may be one or more sound flap hook and loop fasteners or a sound flap zipper. The sound flap may roll up when the sound flap fastener is detached.

In some embodiments, the invention 100 may comprise the speaker stand 280 to support the base 200, the plurality of support armatures 230, the tent body 240, and the speaker 900 at the elevated position. The speaker stand 280 may comprise a vertical armature 282 and a tripod base 284. The top of the vertical armature 282 may detachably couple to the stand aperture of the stand interface 210 and the bottom of the vertical armature 282 may couple to the tripod base 284. The tripod base 284 may provide stability for the speaker stand 280 by enlarging the footprint of the speaker stand 280.

In use, a speaker 900 may be placed on the center of the base 200 and the tent body 240 may be secured to the framework using the plurality of tent body restraints 270. In some embodiments, the base 200 may be placed on top of the speaker stand 280 by placing the top of the vertical armature 282 of the speaker stand 280 into the stand aperture 214 on the stand interface 210. The access panel 250 may be unfastened and opened to provide access to the speaker 900 for accessing power switch and/or volume controls, making electrical connections, selected a wireless channel, changing batteries, or any combination thereof. The access panel 250 may be then be closed and secured to block rain. In good weather, the sound flap may be unfastened and opened. During inclement weather, the sound flap may be closed and secured.

DEFINITIONS

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used in this disclosure, a "cavity" may be an empty space or negative space that is formed within an object.

As used herein, the words "couple", "couples", "coupled" or "coupling", may refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, the terms "distal" and "proximal" may be used to describe relative positions. Distal refers to the object, or the end of an object, that is situated away from the point of origin, point of reference, or point of attachment. Proximal refers to an object, or end of an object, that is situated towards the point of origin, point of reference, or point of attachment. Distal implies 'farther away from' and proximal implies 'closer to'. In some instances, the point of attachment may be the where an operator or user of the object makes contact with the object. In some instances, the point of origin or point of reference may be a center point, a central axis, or a centerline of an object and the direction of comparison may be in a radial or lateral direction.

As used in this disclosure, a "fastener" may be a device that is used to join or affix two objects. Fasteners may generally comprise a first element which is attached to the first object and a second element which is attached to the second object such that the first element and the second element join to affix the first object and the second object. Common fasteners may include, but are not limited to, hooks, zippers, snaps, clips, ties, buttons, buckles, quick release buckles, or hook and loop fasteners.

As used in this disclosure, a "flap" may be a piece of material that is hinged or otherwise attached to a surface using one side. In some embodiments, the piece of material may hang in such a way as to cover a hole in a surface, to provide a barrier between objects, or to provide a grasping point.

As used here, "footprint" may refer to a projection of an object onto the surface that supports the object. The projection is usually, but not always, vertically downward.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "hook and loop fastener" may be a fastener that comprises a hook surface and a loop surface. The hook surface may comprise a plurality of minute hooks. The loop surface may comprise a surface of uncut pile that acts like a plurality of loops. When the hook surface is applied to the loop surface, the plurality of minute hooks may couple to the plurality of loops securely fastening the hook surface to the loop surface. The hook surface may sometime be referred to as a hard side fastener and the loop surface may sometimes be referred to as a soft side fastener.

As used herein, the words "invert", "inverted", or "inversion" may refer to an object that has been turned inside out or upside down or to the act of turning an object inside out or upside down.

As used in this disclosure, a "magnet" may be an ore, alloy, or other material that has its component atoms arranged so that the material exhibits properties of magnetism such as attracting iron-containing objects or aligning itself in an external magnetic field.

As used in this disclosure, a "speaker" may be an electrical transducer that converts an electrical signal into an audible sound, A speaker may also be referred to as a loudspeaker.

As used in this disclosure, "vertical" may refer to a direction that is parallel to the local force of gravity. Unless specifically noted in this disclosure, the vertical direction is always perpendicular to horizontal.

As used herein, "water repellent" may refer to the hydrophobic characteristic of an object. Water does not easily penetrate a water repellent object. The water repellent characteristic may be intrinsic to the type of material that the object is made of or it may be the result of a coating applied to the object.

As used in this disclosure, "wireless" may be an adjective that is used to describe a communication channel that does not require the use of physical cabling.

As used in this disclosure, a "zipper" may be a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A protective tent for speakers comprising:

a base, a plurality of support armatures, and a tent body;

wherein the protective tent for speakers shields a speaker to protect the speaker from damage due to weather;

wherein the base and the plurality of support armatures form a framework to support the tent body;

wherein the tent body is operable to enshroud the speaker;

wherein the tent body is water repellent such that the speaker enclosed within the tent body stays dry during a rainstorm;

wherein the base is the bottom of the framework that supports the tent body;

wherein the base comprises a stand interface and a plurality of arms;

wherein the stand interface is a central disk located at the center of the base;

wherein the stand interface comprises a plurality of arm apertures dispersed around the side of the stand interface for coupling the plurality of arms to the stand interface;

wherein the stand interface comprises a stand aperture at a bottom center of the stand interface;

wherein an individual arm selected from the plurality of arms comprises a straight armature, a 90 degree elbow, and a first magnet;

wherein the straight armature extends away from the stand interface to define a diameter of the protective tent for speakers;

wherein the plurality of arms are coupled to the stand interface via the plurality of arm apertures;

wherein the plurality of arms are radially-oriented and equally spaced around the stand interface;

wherein a first end of the 90 degree elbow is coupled to the distal end of the straight armature;

wherein the 90 degree elbow turns 90 degrees such that a second end of the 90 degree elbow is pointed vertically upwards;

wherein the first magnet is coupled to the second end of the 90 degree elbow;

wherein the plurality of support armatures couple to the 90 degree elbows located at the distal ends of the plurality of arms to form an arching structure that extends vertically upwards;

wherein the plurality of support armatures lift the center of the tent body such that a hollow cavity is formed within the tent body;

wherein the speaker is placed within the hollow cavity;

wherein an individual support armature selected from the plurality of support armatures is the shape of an inverted U;

wherein the individual support armature couples to the 90 degree elbows of two opposing arms.

2. The protective tent for speakers according to claim 1 wherein the individual support armature comprises a plurality of second magnets;

wherein an individual second magnet selected from the plurality of second magnets is coupled to each end of the individual support armature.

3. The protective tent for speakers according to claim 2 wherein the first magnet and the individual second magnet are magnetically polarized such that the first magnet is attracted to the individual second magnet.

4. The protective tent for speakers according to claim 3 wherein the protective tent for speakers comprises two support armatures;

wherein the two support armatures are different vertical heights such that the bottoms of the two support armatures are at the height of the 90 degree elbows and the centers of the two support armatures cross paths without interference.

5. The protective tent for speakers according to claim 3 wherein the tent body is a water repellent fabric that fits over the plurality of support armatures to form the hollow cavity.

6. The protective tent for speakers according to claim 5 wherein the tent body comprises a cylindrical bottom and a hemispherical top.

7. The protective tent for speakers according to claim 6 wherein an access panel provides access to the speaker;

wherein the access panel opens to expose an access aperture and closes to cover the access aperture;

wherein the access panel is located on the rear of the tent body;

wherein the access panel couples to the tent body at the top of the access panel and is detached from the tent body along the left side of the access panel, the right side of the access panel, and the bottom of the access panel;

wherein the bottom of the access panel lifts up;

wherein an access panel fastener detachably couples the left side of the access panel, the right side of the access panel, and the bottom of the access panel to the tent body.

8. The protective tent for speakers according to claim 7 wherein the access panel fastener is one or more access door hook and loop fasteners or an access panel zipper;

wherein the access panel rolls up when the access panel fastener is detached.

9. The protective tent for speakers according to claim 8 wherein a plurality of tent body restraints are operable to detachably couple the tent body to the framework.

10. The protective tent for speakers according to claim 9 wherein the plurality of tent body restraints are tent body hooks on the tent body that couple to rings on the plurality of arms, tent body hook and loop fasteners, one or more drawstrings that lash to the base and/or the plurality of support armatures, or any combination thereof.

11. The protective tent for speakers according to claim 10 wherein a sound flap is provided to expose the front of the speaker in good weather;

wherein the sound flap opens to expose a sound aperture and closes to cover the sound aperture;

wherein the sound flap is located on the front of the tent body;

wherein the sound flap couples to the tent body at the top of the sound flap and is detached from the tent body along the left side of the sound flap, the right side of the sound flap, and the bottom of the sound flap;

wherein the bottom of the sound flap lifts up;

wherein a sound flap fastener detachably couples the left side of the sound flap, the right side of the sound flap, and the bottom of the sound flap to the tent body.

12. The protective tent for speakers according to claim 11 wherein the sound flap fastener is one or more sound flap hook and loop fasteners or a sound flap zipper;

wherein the sound flap rolls up when the sound flap fastener is detached.

13. The protective tent for speakers according to claim 12 wherein the protective tent for speakers comprises a speaker stand to support the base, the plurality of support armatures, the tent body, and the speaker at an elevated position;

wherein the speaker stand comprises a vertical armature and a tripod base;

wherein the top of the vertical armature detachably couples to the stand aperture of the stand interface and the bottom of the vertical armature couples to the tripod base;

wherein the tripod base provides stability for the speaker stand by enlarging the footprint of the speaker stand.

* * * * *